US009919194B2

(12) United States Patent
Jasmine

(10) Patent No.: US 9,919,194 B2
(45) Date of Patent: Mar. 20, 2018

(54) CONTOURED TERRAIN-CONFORMING STANCE GUIDE WITH FOOT OPENING

(71) Applicant: Chad Jasmine, Ponte Vedra, FL (US)

(72) Inventor: Chad Jasmine, Ponte Vedra, FL (US)

( * ) Notice: Subject to any disclaimer, the term of this patent is extended or adjusted under 35 U.S.C. 154(b) by 138 days.

(21) Appl. No.: 14/972,177

(22) Filed: Dec. 17, 2015

(65) Prior Publication Data

US 2017/0173429 A1 Jun. 22, 2017

(51) Int. Cl.

| | |
|---|---|
| ***A63B 69/00*** | (2006.01) |
| ***A63B 57/20*** | (2015.01) |
| *A63B 69/36* | (2006.01) |
| *A63B 71/06* | (2006.01) |
| *A63B 102/20* | (2015.01) |
| *A63B 102/18* | (2015.01) |

(52) U.S. Cl.

CPC ..... *A63B 69/0002* (2013.01); *A63B 57/203* (2015.10); *A63B 69/3667* (2013.01); *A63B 69/3661* (2013.01); *A63B 2069/0008* (2013.01); *A63B 2071/0694* (2013.01); *A63B 2102/182* (2015.10); *A63B 2102/20* (2015.10)

(58) Field of Classification Search

CPC ..... A63B 69/00
USPC ..... 473/452, 217, 218
See application file for complete search history.

(56) References Cited

U.S. PATENT DOCUMENTS 1,831,851 A * 11/1931 Everett ..... A43B 5/18 36/127
2,316,994 A * 4/1943 Silva ..... A63B 69/002 434/251
2,849,237 A * 8/1958 Simithis ..... A43B 5/00 36/132
3,342,487 A * 9/1967 David ..... A63B 69/0002 434/247
3,363,903 A * 1/1968 O'Brien ..... A63B 69/3667 473/273
3,372,930 A * 3/1968 Sertich ..... A63B 22/14 473/452
3,381,377 A * 5/1968 Grayson ..... A61C 19/05 433/27
4,109,661 A * 8/1978 Fukuoka ..... A43B 1/0054 36/11.5
4,348,821 A * 9/1982 Daswick ..... A43B 13/12 36/103
4,476,638 A * 10/1984 Quacquarini ..... A43B 17/12 36/103
4,544,160 A * 10/1985 Miner ..... A63B 69/3676 473/218
4,736,952 A * 4/1988 Taft ..... A63B 69/3623 473/218
5,197,739 A * 3/1993 Johnson ..... A63B 69/3667 473/271

(Continued)

*Primary Examiner* — John E Simms, Jr.
*Assistant Examiner* — Dolores Collins
(74) *Attorney, Agent, or Firm* — Mark Young, P.A.

(57) ABSTRACT

A generally U- or oval shaped flexible plastic stance guide lies flat on terrain, regardless of terrain contour, and defines a central opening for placement of a foot on the terrain. Gently sloped leading and trailing edges with an arcuate or planar median between the leading and trailing edges provide a palpable low-profile periphery around the opening. Parallel and perpendicular guide markings facilitate positioning and orienting the guide and a foot for a particular task. The bottom may be textured with spikes to enhance frictional engagement.

17 Claims, 16 Drawing Sheets

(56) References Cited

U.S. PATENT DOCUMENTS 5,327,664 A * 7/1994 Rothbart ..... A43B 7/14 36/174
5,338,037 A * 8/1994 Toyohara ..... A63B 69/3623 434/252
D385,610 S * 10/1997 McDonald ..... D21/790
5,673,448 A * 10/1997 Lang ..... A43B 5/0405 12/142 P
5,864,969 A * 2/1999 Mauch ..... A43B 1/0054 36/141
5,997,018 A * 12/1999 Lee ..... A63C 17/0046 280/11.28
6,432,001 B1 * 8/2002 Pierce ..... A43B 5/18 36/127
6,500,075 B1 * 12/2002 McDevitt ..... A63B 69/3641 473/218
6,665,956 B2 * 12/2003 Hay ..... A43B 7/141 36/142
6,723,003 B1 * 4/2004 Harrell ..... A63B 69/3667 473/266
6,869,371 B2 * 3/2005 Perry ..... A63B 69/3667 473/266
6,926,625 B1 * 8/2005 Fruechting ..... A63B 69/0002 473/218
7,033,289 B2 * 4/2006 Sharrocks ..... A63B 69/002 473/422
7,172,521 B1 * 2/2007 Novis ..... A63B 69/002 473/422
7,418,755 B2 * 9/2008 Bledsoe ..... A43B 7/28 12/142 N
8,128,518 B1 * 3/2012 Kudla ..... A63B 69/0026 473/478
8,226,533 B2 * 7/2012 Wessels ..... A63B 21/0004 482/105
8,408,320 B2 * 4/2013 Burns ..... A01L 3/00 168/12
8,414,414 B2 * 4/2013 Viramontez ..... A63B 69/0002 473/270
D714,406 S * 9/2014 Saruma ..... D21/698
8,944,941 B2 * 2/2015 Carlson ..... A63B 69/0013 473/497
2003/0057679 A1 * 3/2003 Pollmiller ..... A63C 10/14 280/611
2005/0086838 A1 * 4/2005 Khantzis ..... A43B 1/0045 36/30 R
2007/0243955 A1 * 10/2007 Du Brock ..... A63B 69/0002 473/452
2011/0003652 A1 * 1/2011 Brend ..... A63B 69/00 473/452
2013/0267340 A1 * 10/2013 Wolf ..... A63B 69/3641 473/226
2013/0277070 A1 * 10/2013 Burns ..... A01L 5/00 168/4
2013/0277076 A1 * 10/2013 Ley ..... A01B 76/00 172/509

* cited by examiner

CONTOURED TERRAIN-CONFORMING STANCE GUIDE WITH FOOT OPENING

FIELD OF THE INVENTION

This invention relates generally to stance training, and, more particularly, to a contoured guide that has a foot opening and conforms to terrain.

BACKGROUND

For beginning baseball and softball players, finding the right stance is critical for hitting success at the plate. Upon watching professional baseball players today, one might begin to think that there isn't a single correct stance, and that's a correct assumption. However, when beginning to play ball and acclimating oneself to a proper stance and swing mechanics, there are time-tested guidelines to follow.

One key to a proper stance is foot positioning. Unfortunately, beginners may have difficulty consistently positioning their feet for a proper stance, and it may be impractical for a parent or coach to correct foot positioning while a batter is at the plate. Additionally, it may be dangerous for a parent or coach to approach a batter, particularly an eager novice, at the plate. Even if a coach initially positions the player's feet, many novice batters have a tendency to move their feet before taking a swing.

The same challenges apply to golf. Proper stance, including foot positioning relative to a tee and ball, is critical for an effective swing. Again, beginners may have difficulty consistently positioning their feet for a proper stance, and it may be impractical and dangerous for a parent or coach to correct foot positioning while a golfer is addressing the ball.

Other sports requiring a proper stance and swing, such as cricket, may also present the same challenges. In each case, a novice may not know or remember where to place his or her feet. In each case, intervention by a coach or parent may be impractical (e.g., time consuming, embarrassing, or against the rules during an official game or match), risk injury to the instructor, and an inferior method for teaching the player to independently properly locate his or her feet. In each case the player may move his or her feet, after proper positioning, without being aware that such movement has taken place.

Many other activities also require a proper stance. Non-limiting examples of such activities include firearm training, archery and combat. By way of example, the "Weaver stance" for shooting a firearm entails positioning the feet in a boxing stance, with the non-shooting side foot ahead of the shooting side foot. A person shooting right-handed will have the right foot angled out to approximately forty-five degrees to the side and to the rear at shoulder length. In contrast, the "Isosceles stance" for shooting a firearm involves positioning the feet shoulder width apart, with the support-side foot slightly forward, and the knees bent, shifting the center of mass forward to help the shooter better control recoil. In archery, with a right hand bow, the archer's left foot will be on the "down range" side or the target side of the shooting line, with feet spaced approximately shoulder width apart and parallel to the shooting line.

In combat, various stances, including open and closed stances, are used, with increased lateral distance between the lead and rear foot in an open stance. While open stances are more stable than closed stances, they leave one vulnerable to groin attacks and expose a larger portion of the body to an opponent. Closed stances help agility, but can be unstable.

As with stances for many other activities, the bend in the knees, the height relative to a normal standing position, and the shifting of body weight over one foot, the other foot, or evenly, varies according to combat objectives.

What is needed is a device that does not interfere with the activity, is intuitive and easy to use, can be setup and configured in a matter seconds, can be used on various terrains with various users having various stances and physiques, and allows a user's foot to maintain contact with actual terrain during use. The invention is directed to overcoming one or more of the problems and solving one or more of the needs as set forth above.

SUMMARY OF THE INVENTION

To solve one or more of the problems set forth above, a stance guide according to principles of the invention is comprised of a plastic ring or u-shaped apparatus that lies flat on terrain, regardless of terrain contour, and defines a central opening for placement of a foot on the terrain. The apparatus includes gently sloped leading and trailing edges, with an arcuate or planar median between the leading and trailing edges. The sloped edges provide a palpable periphery around the opening. The maximum height of the apparatus is not more than an inch. While palpable, the gradual slope and limited overall height do not cause appreciable flexion, eversion, inversion, extension or pronation of foot or ankle of a user traversing the apparatus. Thus, risk of injury is minimized. The apparatus also includes guide markings to facilitate positioning and orienting the apparatus for a particular task. The bottom of the apparatus may be textured with spikes or other protrusions to enhance frictional engagement with the terrain. Such frictional engagement resists sliding motion of the apparatus when contacted by a user's foot. To further lock the apparatus in place, in one exemplary embodiment the apparatus includes one or more apertures through which an elongated pointed shank of a golf tee may extend into the ground, with the head of the tee recessed or substantially flush with the median.

Advantageously, once a pair of stance guides is properly positioned, such as by a user, coach or trainer, the user may readily locate his or her feet while standing on actual terrain, and traverse the apparatus without risks of injury or unintentionally moving the apparatus.

In one exemplary embodiment, a stance guide according to principles of the invention includes a front side having a front side length greater than a width of a shoe of a user, a left end and a right end opposite the left end. A left side extends from the left end of the front side. The left side is elongate (i.e., long in relation to width) and substantially perpendicular to the front side. A right side extends from the right end of the front side. The right side is elongate and substantially perpendicular to the front side and substantially aligned with, spaced apart from, and parallel to the left side. The front side, left side, and right side form a generally U-shape with a stance space defined between the left side and the right side. The stance space has a width defined by a distance between the left side and the right side. The width is greater than the width of the shoe of a user.

In another exemplary embodiment, the guide also includes a back side having a length about equal to the length of the front side. The back side is spaced apart from the front side and generally parallel to the front side. In this embodiment the guide is generally O or oval shaped.

In each embodiment, the front side, left side and right side are integrally formed and comprised of flexible plastic. The stance guide conforming to a contour of a terrain on which the stance guide is placed.

Each of the front side, left side and right side has an outer edge and an opposite inner edge. The outer edge is sloped to an outer edge height, and the inner edge is sloped to an inner edge height. The inner edge height is less than the outer edge height, and the outer edge height does not exceeding one inch. The sloped outer edge and sloped inner edge may each be a filleted, beveled or chamfered outer edge.

The guide includes several guidelines for guide alignment as well as foot alignment. The front side has a middle between the left end and the right end, with a central guideline at the middle. The central guideline is visible and substantially parallel to the left side and right side. The central guideline at the middle of the front side is palpable and is comprised of a linear embossment (i.e., embossed feature) or a linear debossment (i.e., debossed feature). A front edge guideline on the front side is generally perpendicular to the central guideline, has a front edge guideline length that is less than the front side length, has a first end adjacent to the left end of the front side, has a second end adjacent to the right end of the front side, and extends linearly between the left end and the right end of the front side. The front edge guideline on the front side is palpable and comprised of a linear embossment or a linear debossment. A left guideline and a right guideline are also provided. The left guideline is parallel to and spaced apart from the right guideline. The left guideline and the right guideline are perpendicular to the central guideline. The left guideline extends from the first end of the front edge guideline along a portion of the left side. The right guideline extends from the second end of the front edge guideline along a portion of the right side.

The front side, left side and right side each have a bottom surface from which a plurality of terrain engaging protrusions extend downwardly. The terrain engaging protrusions may be conical protrusions.

The flexible plastic includes a plasticizer and may also include an additive, such as a thermochromic additive causing the stance guide to change color at a determined temperature or a phosphorescent additive causing the stance guide phosphoresce (e.g., glow in the dark).

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
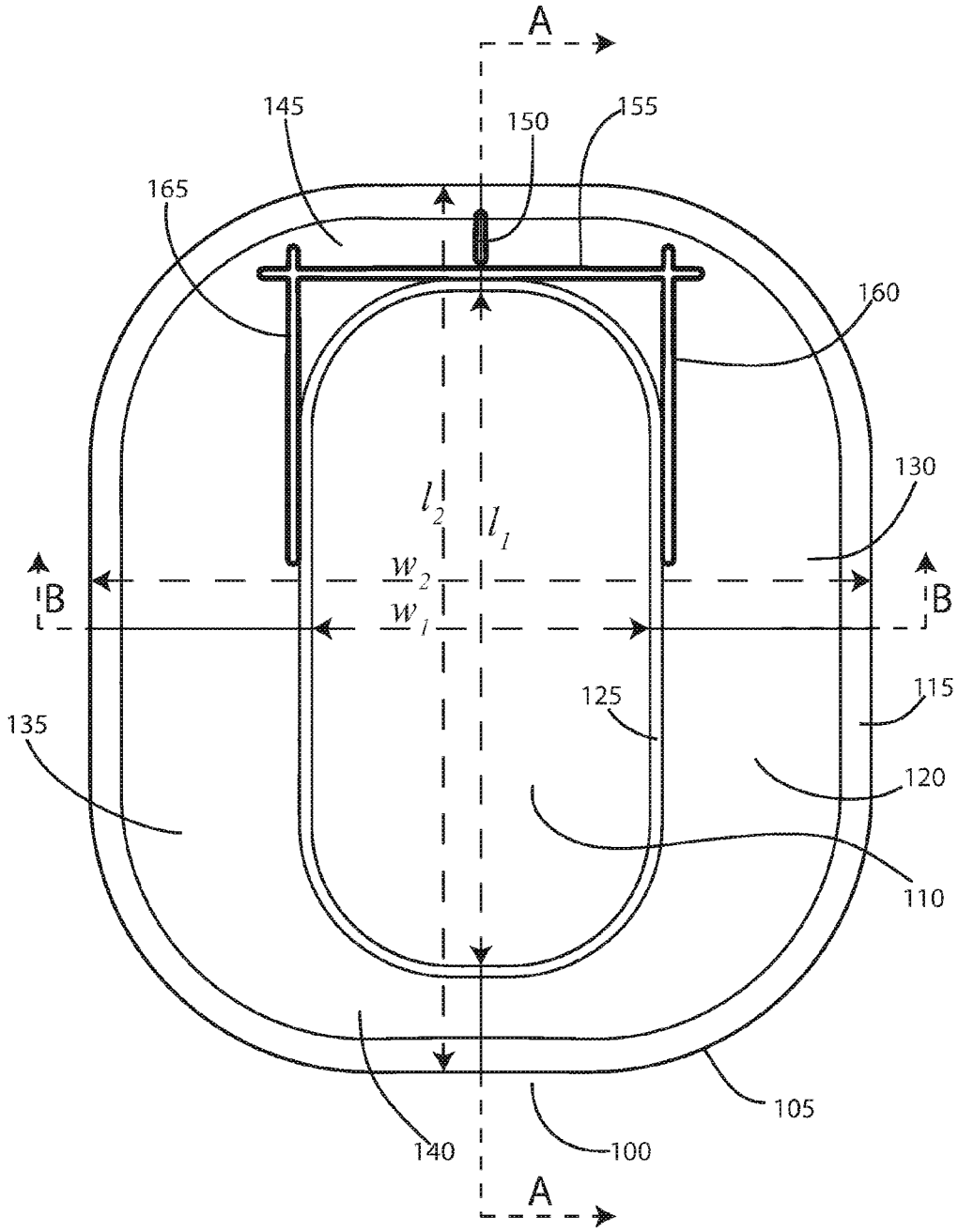
FIG. 1 is a plan view of an exemplary ring-shaped stance guide according to principles of the invention.
Figure 2:
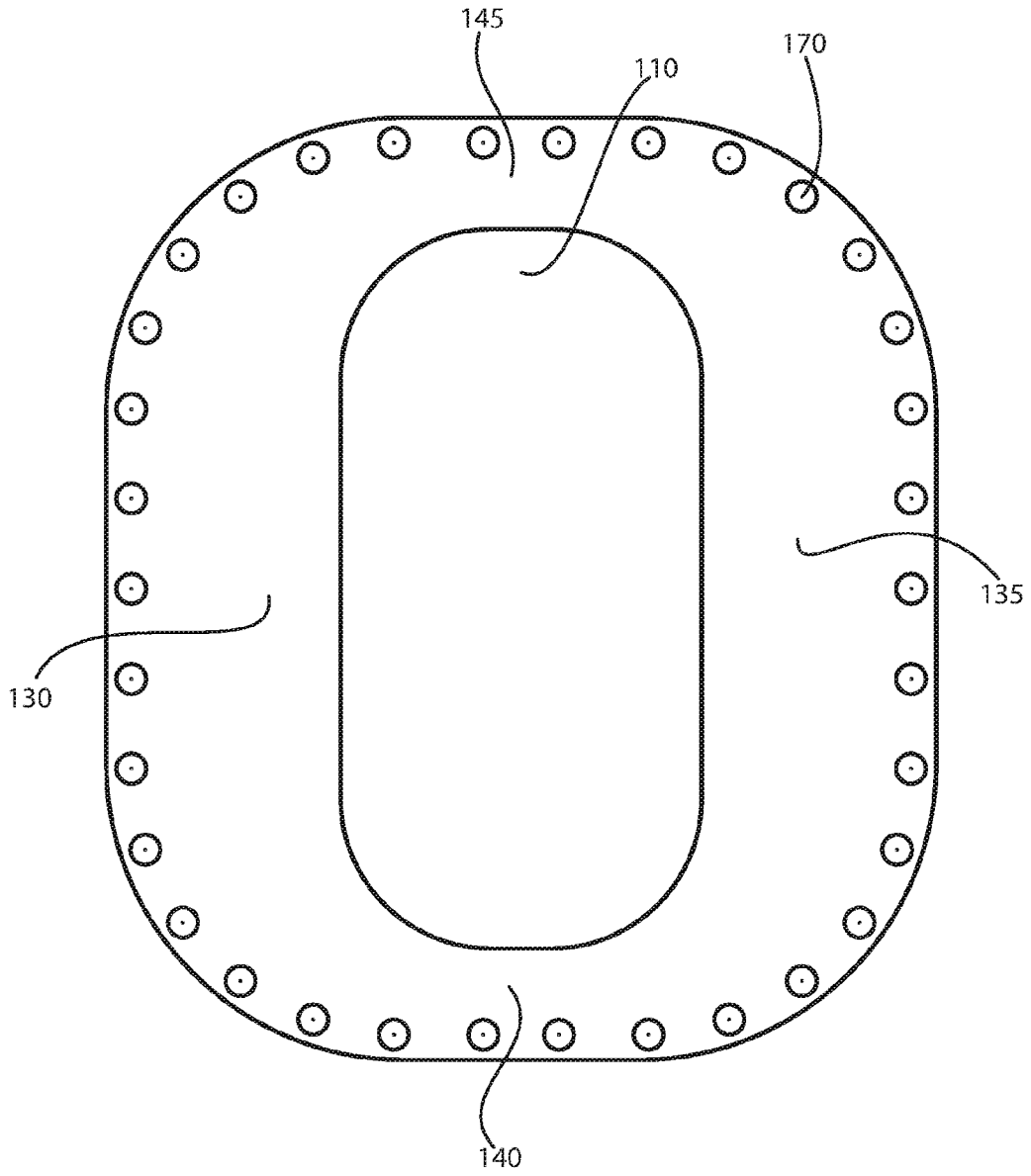
FIG. 2 is a bottom view of an exemplary ring-shaped stance guide according to principles of the invention.
Figure 3:
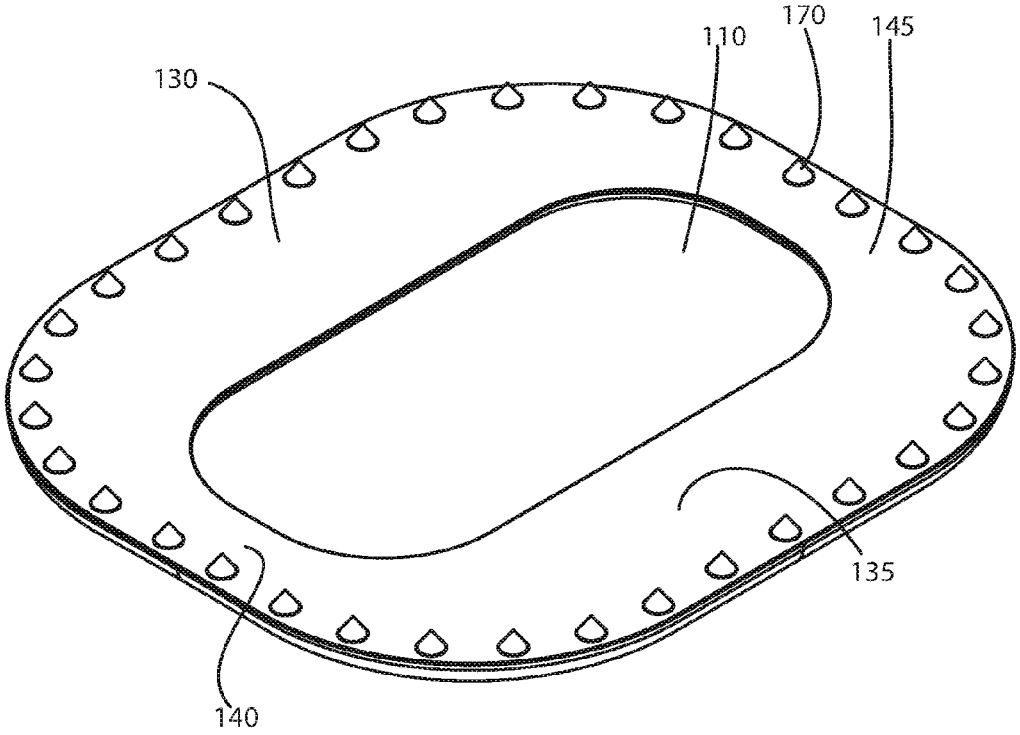
FIG. 3 is a bottom perspective view of an exemplary ring-shaped stance guide according to principles of the invention.
Figure 4:
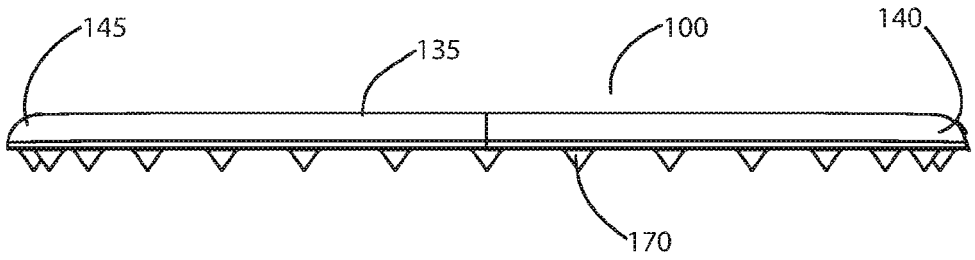
FIG. 4 is a first side view of an exemplary ring-shaped stance guide according to principles of the invention.
Figure 6:
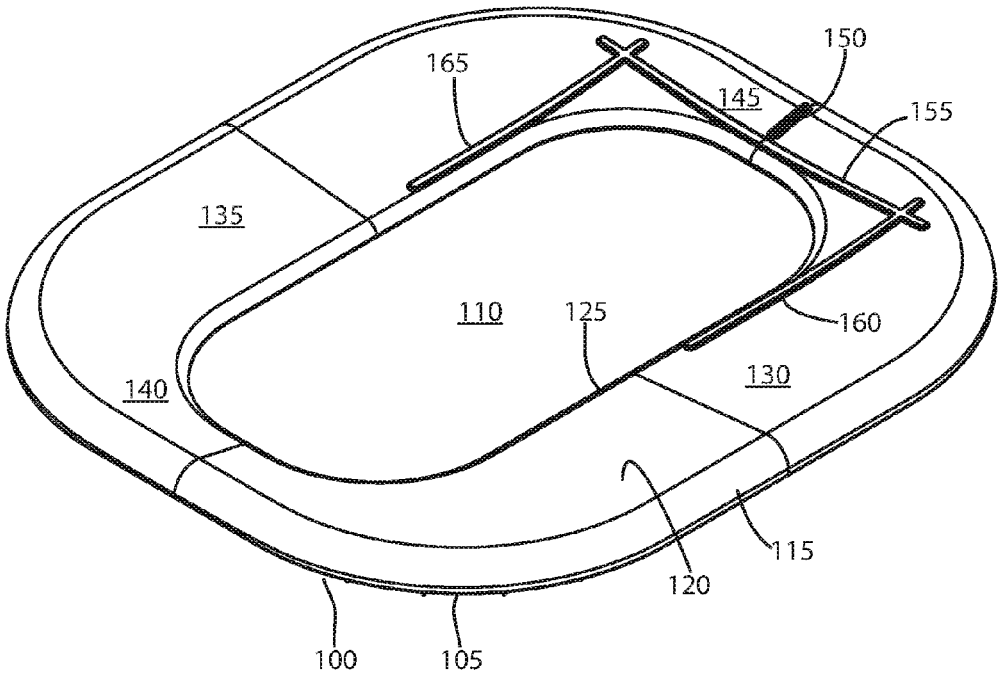
FIG. 6 is a top perspective view of an exemplary ring-shaped stance guide according to principles of the invention.

Referring now to FIGS. 1 and 6, top views of an exemplary ring-shaped stance guide 100 according to principles of the invention is provided. A central oblong opening 110 is sized ($w_1$, $l_1$) to receive a user's foot. A length ($l_1$) of approximately 12 inches and a width ($w_1$) of approximately 6 inches will accommodate most adult shoes. However, the invention is not limited to a guide having an opening 110 of approximately 6 by 12 inches. Rather, stance guides according to principles of the invention may have central openings sized to receive children or adult shoes. Thus, by way of example, lengths ($l_1$) of 6 to 15 inches and widths ($w_1$) of 4 to 9 inches may be utilized. Additionally, openings having shapes that are not oblong may be utilized without departing from the scope of the invention. The overall length ($l_2$) and width ($w_2$) may exceed the aperture length and width ($l_1$, $w_1$) by a few inches or more.

The ring-shaped stance guide 100 is a bisymmetric structure that includes opposed right and left sides 130, 135, and opposed back and front sides 140, 145. Each of the sides 130, 135, 140, 145 includes a gradually sloped outer periphery 115 terminating at an outer edge 105, a gradually sloped inner periphery 125, and an intermediate median 120 that extends from the inner periphery 125 to the outer periphery 115. The gradually sloped edges may be beveled, filleted or chamfered. Nonlimiting examples include half bullnose, demi-bullnose, ¼ top round, ogee-bullnose, and dupont edges.

Figure 5:
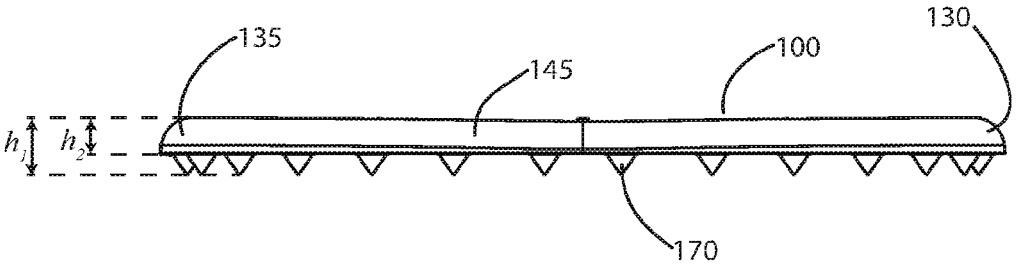
FIG. 5 is a second side view of an exemplary ring-shaped stance guide according to principles of the invention.

With reference to FIG. 5, the overall height ($h_1$) of the guide, including spikes 170, is less than two inches, preferably about an inch. The height ($h_2$) of the guide, excluding spikes 170, is about an inch.

The limited height and gradually sloped edges are palpable, yet avoid pronounced flexion, eversion, inversion, extension or pronation of a foot or ankle of a user traversing the apparatus. A user may readily sense the edges, to determine that his or foot is moving out of position. Additionally, players may traverse the guide 100 without stubbing against the side edges.

The exemplary stance guide includes a plurality of parallel 150, 160, 165 and an orthogonal 155 guidelines. Each guideline may be embossed, debossed, imprinted or adhered to the guide 100. The guidelines include a pair of spaced apart parallel line 160, 165 and an orthogonal line 155 that intersects each of the parallel lines 160, 165 near an end of each parallel line, adjacent to the front side 145 of the guide 100. The parallel lines 160, 165 extend from about the front side 145 along about at least 25% to 50% of the right and left sides 130, 135. A central guideline 150 extends towards the outer periphery of the front side 145 from the middle of the intersecting guideline 155. The central guideline 150 bisects or abuts the orthogonal line 155 at its middle and runs parallel to the parallel side lines 160, 165. The middle of the intersecting guideline 155 coincides with the middle or centerline longitudinal axis of the stance guide 100 that runs along overall length $l_2$. The central guideline 150 facilitate alignment with a target, such as a point relative to a golf tee or a point in a batter's box. The parallel lines 160, 165, facilitate positioning of a foot with toes between the lines.

FIGS. 2 through 5 provide views of the bottom of the exemplary ring-shaped stance guide according to principles of the invention. An array of generally conical spikes 170 is provided along the bottom surface near the outer periphery of the guide 100. The spikes 170 are an optional feature that enhance frictional engagement with certain terrain, such as turf (natural or artificial), dirt, clay and the like. The spikes 170 may be integrally formed with the guide 100 or separately formed and permanently or removably attached to the bottom of the guide 100. If separately formed, the spikes 170 may be comprised of metal, plastic or composites.

Figure 7:
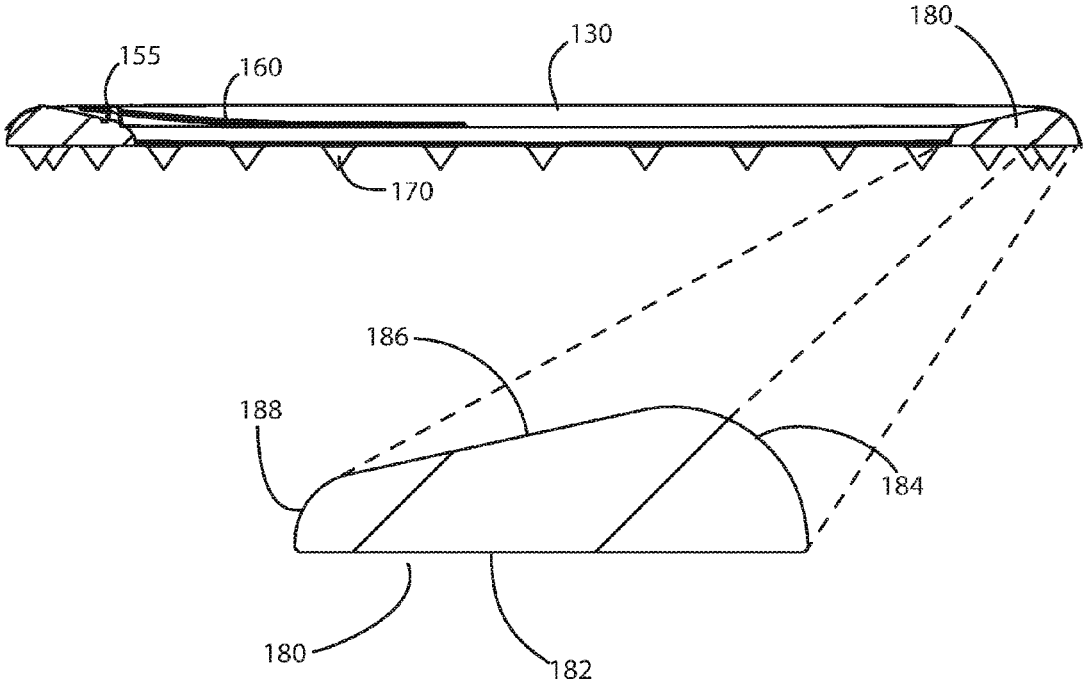
FIG. 7 is a section view of section A-A of the exemplary ring-shaped stance guide of FIG. 1 according to principles of the invention.

FIG. 7 provides a section view of section A-A of the exemplary ring-shaped stance guide 100 of FIG. 1 according to principles of the invention. The cross section 180 includes a substantially planar bottom 182, a curved inner peripheral edge 188, a curved peripheral outer edge 184, and a generally planar intermediate surface 186 extending from the curved inner peripheral edge 188 to the curved peripheral outer edge 184. The height of the curved peripheral outer edge 184 is greater than the height of the curved inner peripheral edge 188. Thus, the planar intermediate surface 186 slopes upwardly from the curved inner peripheral edge 188 to the curved peripheral outer edge 184.

Figure 8:
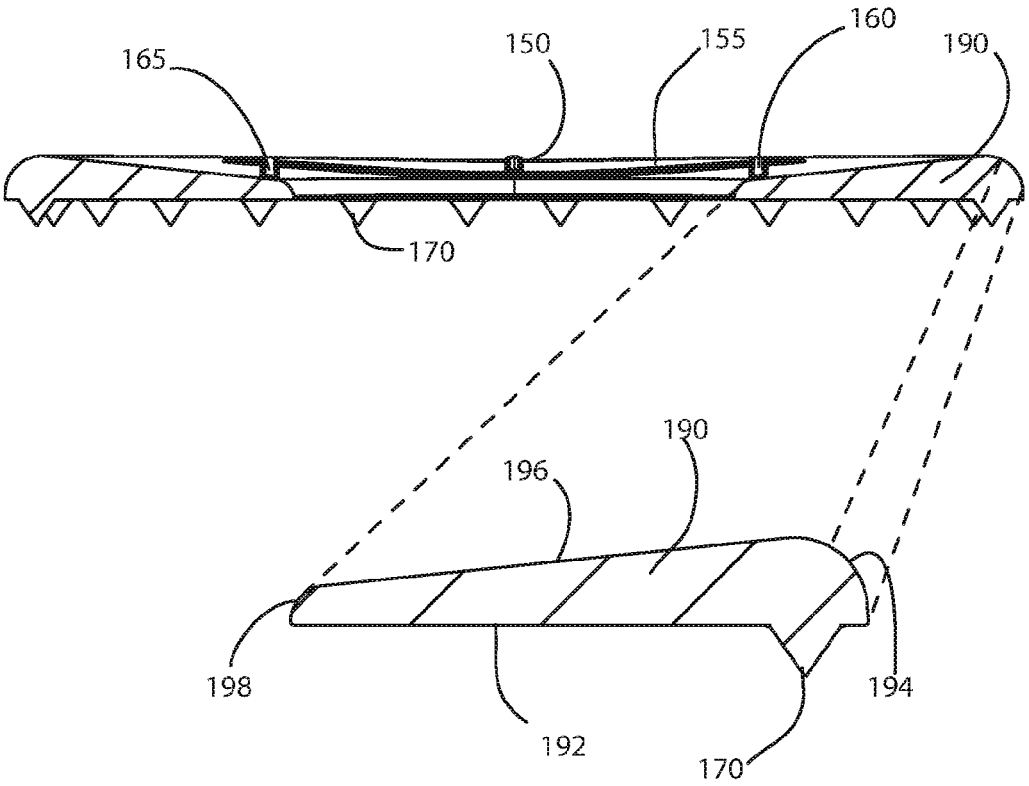
FIG. 8 is a section view of section B-B of the exemplary ring-shaped stance guide of FIG. 1 according to principles of the invention.

FIG. 8 provides a section view of section B-B of the exemplary ring-shaped stance guide 100 of FIG. 1 according to principles of the invention. The cross section 190 includes a substantially planar bottom 192, a curved inner peripheral edge 198, a curved peripheral outer edge 194, and a generally planar intermediate surface 196 extending from the curved inner peripheral edge 198 to the curved peripheral outer edge 194. The height of the curved peripheral outer edge 194 is greater than the height of the curved inner peripheral edge 198. Thus, the planar intermediate surface 196 slopes upwardly from the curved inner peripheral edge 198 to the curved peripheral outer edge 194.

A user's foot, when positioned in the central aperture 110, will contact the curved inner peripheral edges 188, 198, if moved, backwards or forwards or to one side or another, appreciably out of position. The relatively low curved inner peripheral edges 188, 198 are easily sensed (palpable) to the user, without substantially straining the user's foot or ankle. Thus, the inner peripheral edges 188, 198 sensibly alert the user to foot positioning.

The curved peripheral outer edges 184, 194 allow a person to traverse the guide, without injury. For example, if the guide 100 is left in a batter's box, a player sliding into home plate may traverse a portion of the guide 100, sliding over the curved peripheral outer edges 184, 194 without injury.

Figure 9:
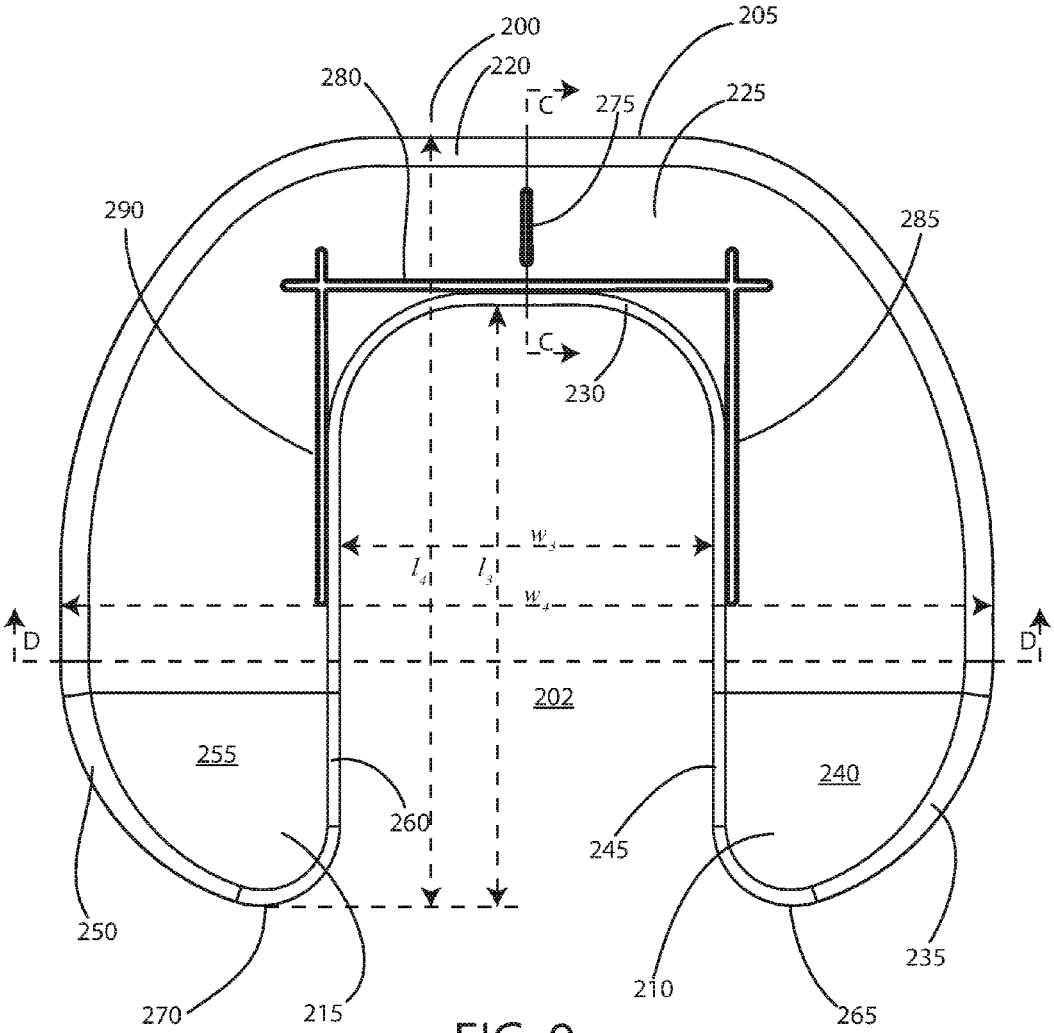
FIG. 9 is a plan view of an exemplary u-shaped stance guide according to principles of the invention.
Figure 11:
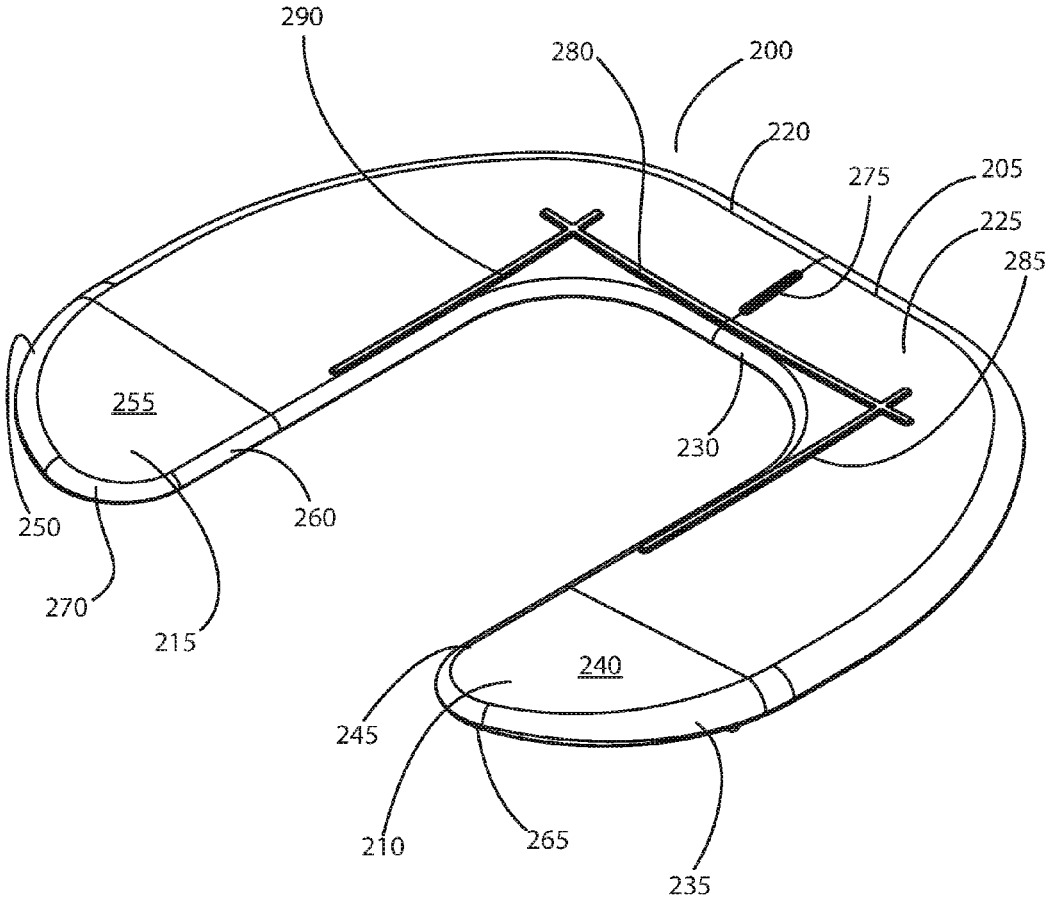
FIG. 11 is a top perspective view of an exemplary u-shaped stance guide according to principles of the invention.

A stance guide according to principles of the invention is not limited to a ring-shape. FIGS. 9 and 11 provide top views of an exemplary u-shaped stance guide 200 according to principles of the invention. A central concave opening 202, accessible between ends 265, 270, is sized ($w_3$, $l_3$) to receive a user's foot. A length ($l_3$) of approximately 8 to 12 inches and a width ($w_3$) of approximately 6 inches will accommodate most adult shoes. However, the invention is not limited to a guide having an opening 202 of approximately 6 by 8 to 12 inches. Rather, stance guides according to principles of the invention may have central openings sized to receive children or adult shoes. Thus, by way of example, lengths ($l_3$) of 6 to 15 inches and widths ($w_3$) of 4 to 9 inches may be utilized. Additionally, concave openings having shapes that are not oblong may be utilized without departing from the scope of the invention. The overall length ($l_4$) and width ($w_4$) may exceed the aperture length and width ($l_3$, $w_3$) by a few inches or more.

The u-shaped stance guide 200 is a symmetric structure that includes opposed right and left sides 240, 255, joined by a generally perpendicular front side 225. Each of the sides 225, 240, 255 includes a gradually sloped outer periphery 220, 235, 250 terminating at an outer edge 205, a gradually sloped inner periphery 230, 245, 260 and an intermediate median 210, 215, 225 that extends from the inner periphery 230, 245, 260 to the outer periphery 220, 235, 250. The gradually sloped edges may be beveled, filleted or chamfered. Nonlimiting examples include half bullnose, demi-bullnose, ¼ top round, ogee-bullnose, and dupont edges.

The overall height of the u-shaped guide 200, including spikes, and excluding spikes, may be about the same as the heights of the ring-shaped embodiment 100.

The limited height and gradually sloped edges are palpable, yet avoid pronounced flexion, eversion, inversion, extension or pronation of a foot or ankle of a user traversing the apparatus. A user may readily sense the edges, to determine that his or foot is moving out of position. Additionally, players may traverse the guide 200 without stubbing against the side edges.

The exemplary u-shaped stance guide 200 includes a plurality of parallel 275, 285, 290 and an orthogonal 280 guidelines. Each guideline may be embossed, debossed, imprinted or adhered to the guide 200. The guidelines include a pair of spaced apart parallel line 285, 290 and an orthogonal line 280 that intersects each of the parallel lines 285, 290 near an end of each parallel line, adjacent to the front side 220 of the guide 200. The parallel lines 285, 290 extend from about the front side 225 along about at least 25% to 50% of the right and left sides 240, 255. A central guideline 275 extends towards the outer periphery of the front side 225 from the middle of the intersecting guideline 280. The central guideline 275 bisects or abuts, or comes close to bisecting or abutting, the orthogonal line 280 at its middle and runs parallel to the parallel side lines 285, 290. The middle of the intersecting guideline 275 coincides with the middle or centerline longitudinal axis of the stance guide 200 that runs along overall length $l_4$. The central guideline 275 facilitate alignment with a target, such as a point relative to a golf tee or a point in a batter's box. The parallel lines 285, 290, facilitate positioning of a foot with toes between the lines.

Figure 10:
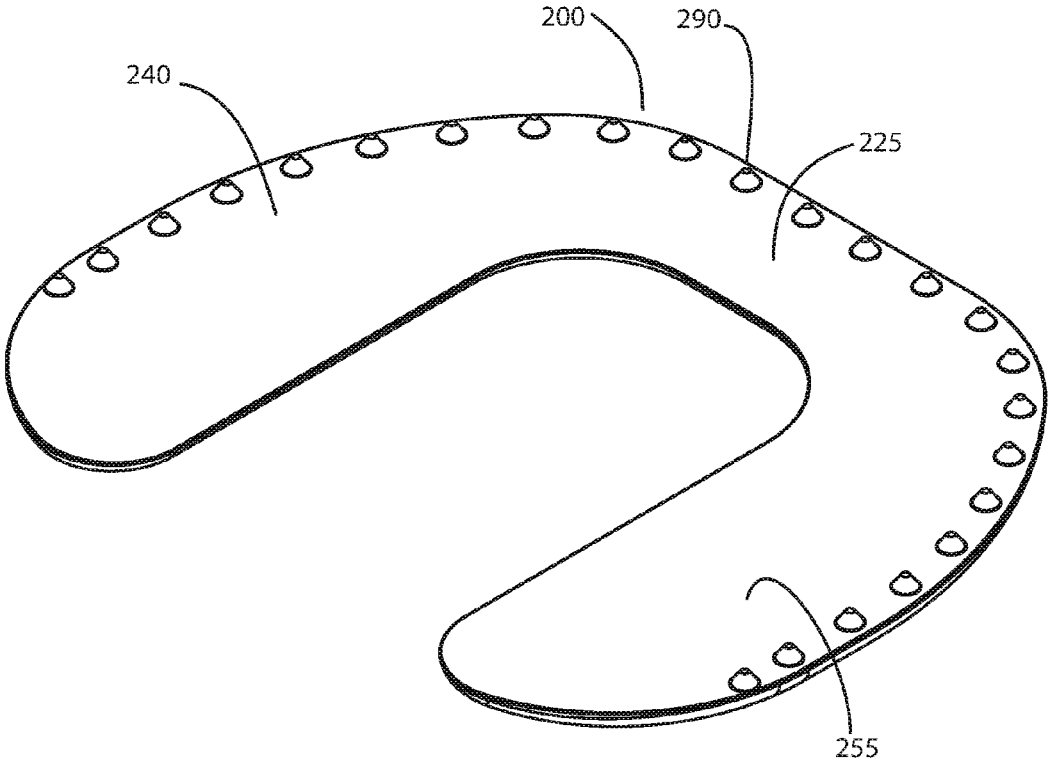
FIG. 10 is a bottom perspective view of an exemplary u-shaped stance guide according to principles of the invention.

FIG. 10 provides a view of the bottom of the exemplary u-shaped stance guide 200 according to principles of the invention. An array of generally conical spikes 290 is provided along the bottom surface near the outer periphery of the guide 200. The spikes 290 are an optional feature that enhance frictional engagement with certain terrain, such as turf (natural or artificial), dirt, clay and the like. The spikes 290 may be integrally formed with the guide 200 or separately formed and permanently or removably attached to the bottom of the guide 200. If separately formed, the spikes 290 may be comprised of metal, plastic or composites.

Figure 12:
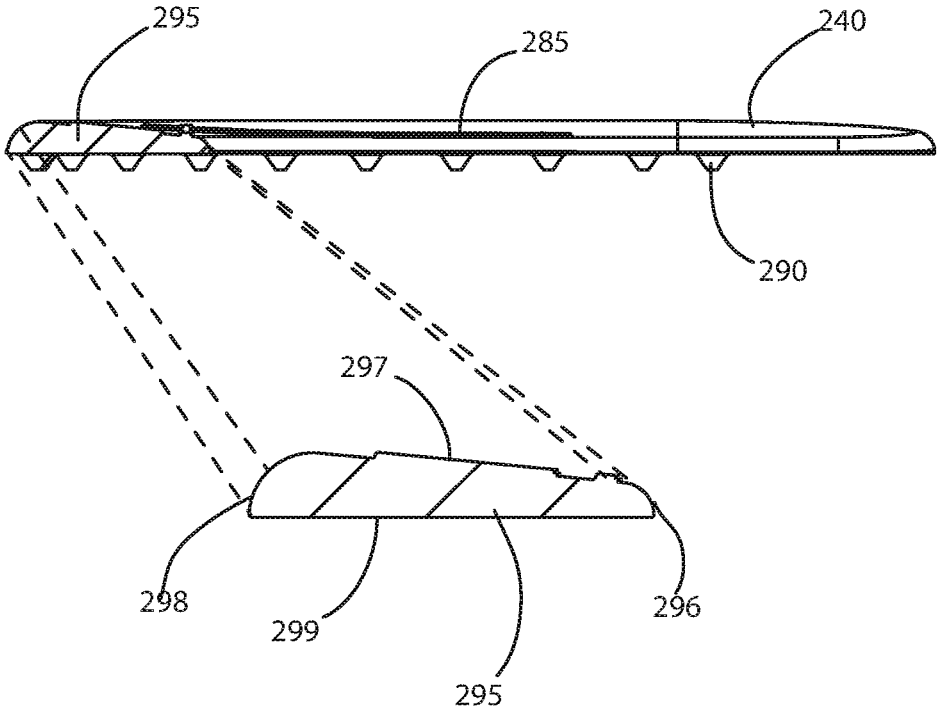
FIG. 12 is a section view of section C-C of the exemplary u-shaped stance guide of FIG. 9 according to principles of the invention.

FIG. 12 provides a section view of section C-C of the exemplary u-shaped stance guide 200 of FIG. 8 according to principles of the invention. The cross section 290 includes a substantially planar bottom 299, a curved inner peripheral edge 296, a curved peripheral outer edge 298, and a generally planar intermediate surface 297 extending from the curved inner peripheral edge 296 to the curved peripheral outer edge 298. The height of the curved peripheral outer edge 298 is greater than the height of the curved inner peripheral edge 296. Thus, the planar intermediate surface 297 slopes upwardly from the curved inner peripheral edge 296 to the curved peripheral outer edge 298.

Figure 13:
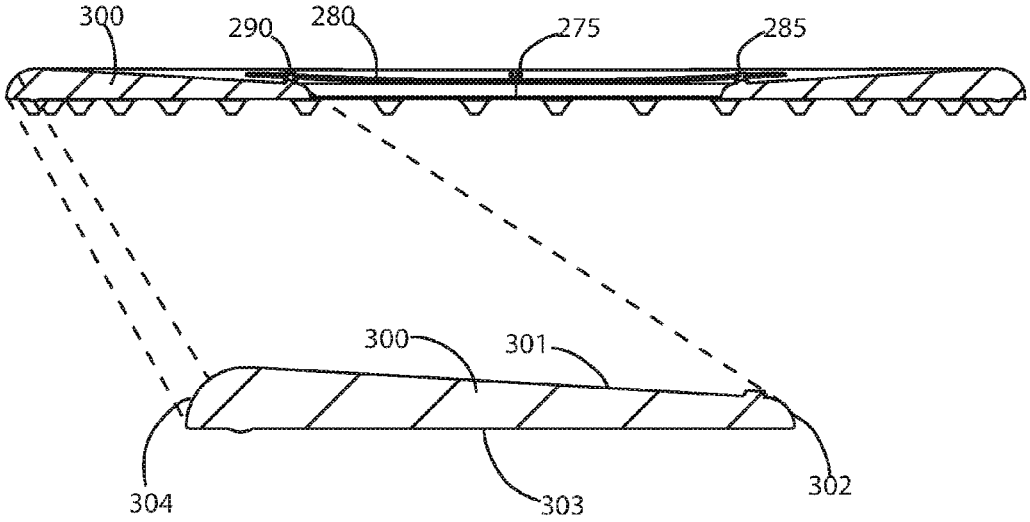
FIG. 13 is a section view of section D-D of the exemplary u-shaped stance guide of FIG. 9 according to principles of the invention.

FIG. 13 provides a section view of section D-D of the exemplary u-shaped stance guide 200 of FIG. 1 according to principles of the invention. The cross section 300 includes a substantially planar bottom 303, a curved inner peripheral edge 302, a curved peripheral outer edge 304, and a generally planar intermediate surface 301 extending from the curved inner peripheral edge 302 to the curved peripheral outer edge 304. The height of the curved peripheral outer edge 304 is greater than the height of the curved inner peripheral edge 302. Thus, the planar intermediate surface 301 slopes upwardly from the curved inner peripheral edge 302 to the curved peripheral outer edge 304.

A user's foot, when positioned in the concave aperture 202, will contact the curved inner peripheral edges 230, 245, 260, if moved, forwards or to one side or another, appreciably out of position. The relatively low curved inner peripheral edges 230, 245, 260 are easily sensed (palpable) to the user, without substantially straining the user's foot or ankle. Thus, the inner peripheral edges 230, 245, 260 sensibly alert the user to foot positioning.

The curved peripheral outer edges 220, 235, 250 allow a person to traverse the guide, without injury. For example, if the guide 200 is left in a batter's box, a player sliding into home plate may traverse a portion of the guide 200, sliding over the curved peripheral outer edges 220, 235, 250 without injury.

As discussed above, the bottom of the guide may be textured with spikes or other protrusions to enhance frictional engagement with the terrain. Such frictional engagement resists sliding motion of the apparatus when contacted by a user's foot. To further lock the apparatus in place, in one exemplary embodiment the guide may include one or more apertures through which an elongated pointed shank of a golf tee may extend into the ground, with the head of the tee recessed or substantially flush with the median.

A guide 100, 200 according to principles of the invention may be comprised of rubber, natural rubber, synthetic rubber, polymers of the organic compound isoprene, artificial elastomer synthesized from petroleum byproducts, and/or any of various plastics. All such materials are referred to herein as an elastomer. In an exemplary implementation, the guide 100, 200 is comprised of a flexible rubber, plastic or polymeric material, such as a polyisoprene, latex, isoprene (2-methyl-1,3-butadiene), chloroprene (2-chloro-1,3-butadiene), isobutylene (methylpropene), polyvinyl chloride (PVC), polyethylene, polypropylene, polystyrene, acrylics, cellulosics, acrylonitrile-butadiene-styrene terpolymers, urethanes, thermo-plastic resins, thermo-plastic elastomers (TPE), acetal resins, polyamides, polycarbonates and polyesters. One nonlimiting example is an expanded plastic material, such as a two-pound density expanded polystyrene, which is weather resistant, very durable, and light weight. A plasticizer, such as a phthalate ester, may be included in the plastic to enhance flexibility and durability. Another example is ethylene propylene diene monomer (M-class) rubber (EPDM), which exhibits outstanding heat, ozone, and weather resistance. While many other materials may be used alone or in combination with the aforementioned materials and/or other materials, without departing from the scope of the present invention, preferably the material is relatively inexpensive, easy to use in manufacturing operations and results in an aesthetically acceptable, flexible, durable, weather resistant product. The material may further include additives to provide desired properties such as desired colors, structural characteristics, glow-in-the dark properties and thermal reactivity (e.g., color changes according to heat).

By way of example and not limitation, the guide 100, 200 may optionally be formulated to change color when it reaches a predetermined or higher temperature. This can be accomplished by mixing a thermochromic additive (e.g., thermochromic pigment) to the base material in an amount that is sufficient to achieve a desired color changing range. As an example, a mixture of approximately 5% to 30% (pbw) of Matsui International Co., Inc.'s Chromicolor concentrate may be introduced to the base material, to provide a plastic structure that visibly changes color at a determined elevated temperature, such as approximately 90 degrees Fahrenheit or higher.

Alternatively, a photochromic additive may be added to the base material in an amount that is effective to achieve a desired color change when the guide 100, 200 is exposed to certain lighting conditions. As an example, a mixture of approximately 5% to 35% (pbw) of Matsui International Co., Inc.'s Photopia additive may be introduced to the base material, to provide a plastic structure that visibly changes color in the presence of sunlight or ultraviolet light.

As another alternative, phosphorescent polymer additives, such as aluminate based phosphors, may be added to adsorb light energy and continue to release that energy as visible light after the energy source is removed. Advantageously, such an embodiment provides a guide 100, 200 that is easy to locate in darkened conditions, making the device easy to spot even at nighttime.

The guide 100, 200 may be produced using any suitable manufacturing techniques known in the art for the chosen material, such as (for example) injection, compression, structural foam, blow, or transfer molding; polyurethane foam processing techniques; vacuum forming; and casting. Preferably, the manufacturing technique is suitable for mass production at relatively low cost per unit, and results in an aesthetically acceptable product with a consistent acceptable quality.

Figure 14:
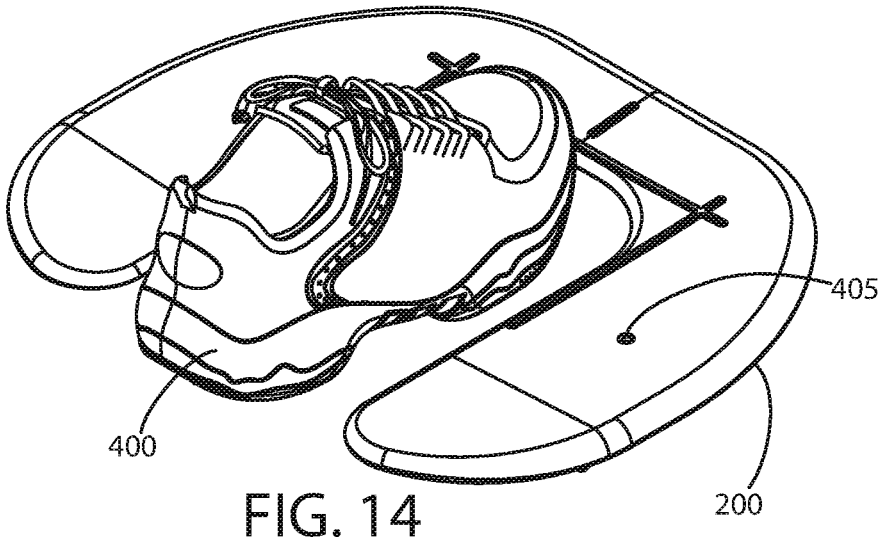
FIG. 14 provides a perspective view of an exemplary u-shaped stance guide according to principles of the invention with an exemplary shoe in an exemplary stance position.
Figure 15:
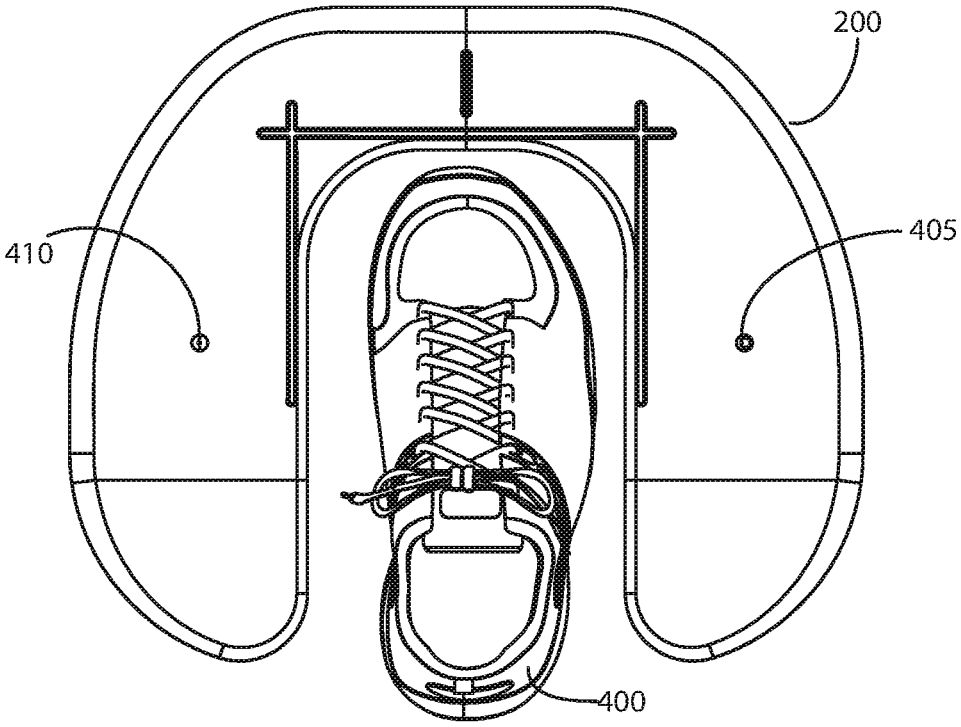
FIG. 15 provides a plan view of an exemplary u-shaped stance guide according to principles of the invention with an exemplary shoe in an exemplary stance position.

With reference to FIGS. 14 and 15 an exemplary shoe 400, which would be worn by a user, is shown in a stance position relative to the exemplary u-shaped stance guide 200 according to principles of the invention. Understandably, the shoe may also be similarly placed in the space (i.e., central oblong opening 110) of the ring-shaped guide 100.

Figure 16:
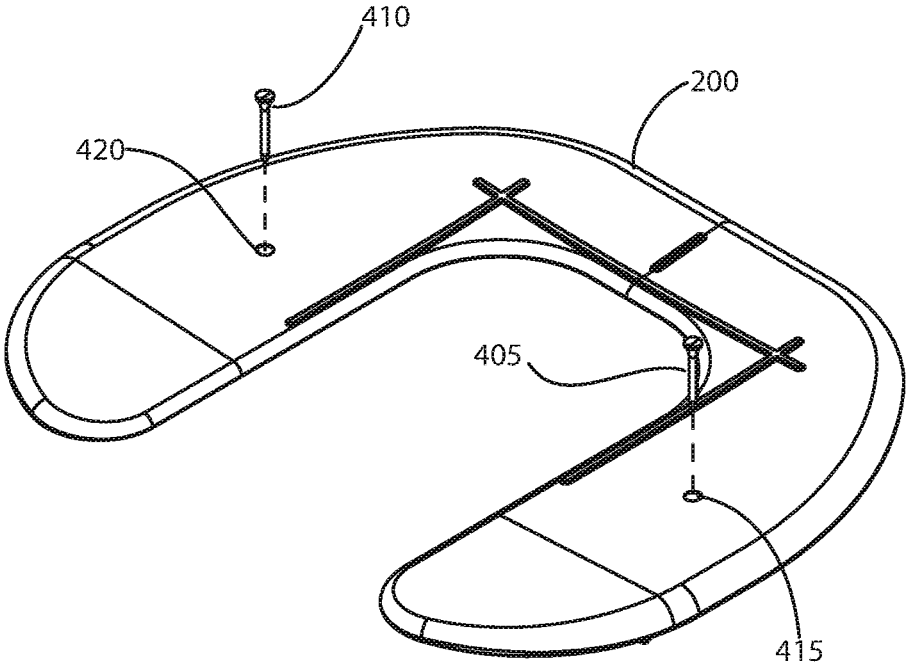
FIG. 16 provides a top perspective view of an exemplary u-shaped stance guide according to principles of the invention with exemplary golf tees as stakes.
Figure 17:
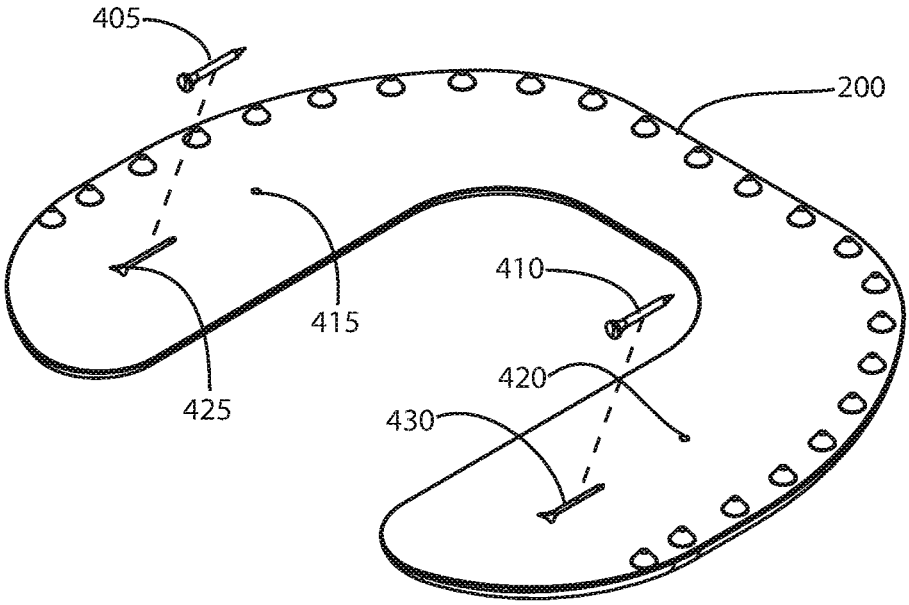
FIG. 17 provides a bottom perspective view of an exemplary u-shaped stance guide according to principles of the invention with exemplary golf tees as stakes and tee storage compartments molded into the bottom surface of the guide.

Also shown in FIGS. 14 and 15, and more clearly in FIGS. 16 and 17, are golf tees 405 and 410, inserted through correspondingly shaped and sized apertures 415 and 420, in the guide 200, to anchor the guide 200 into terrain. The location and number of such apertures and corresponding tees may vary, without departing from the invention. Optionally, the bottom of the guide 200 includes storage compartments for the tees 425, 430, which may be tee-shaped cavities molded into the bottom and sized and configured to securely receive and hold the tees in place for storage and transport. When used, the tees may be popped out of their compartments and inserted into the apertures 415, 420, from the top side of the guide, with the shank of the tee extending into the terrain. Understandably, such tees 405, 410 and apertures 415, 420 may be similarly use in the ring-shaped guide 100.

Figure 18:
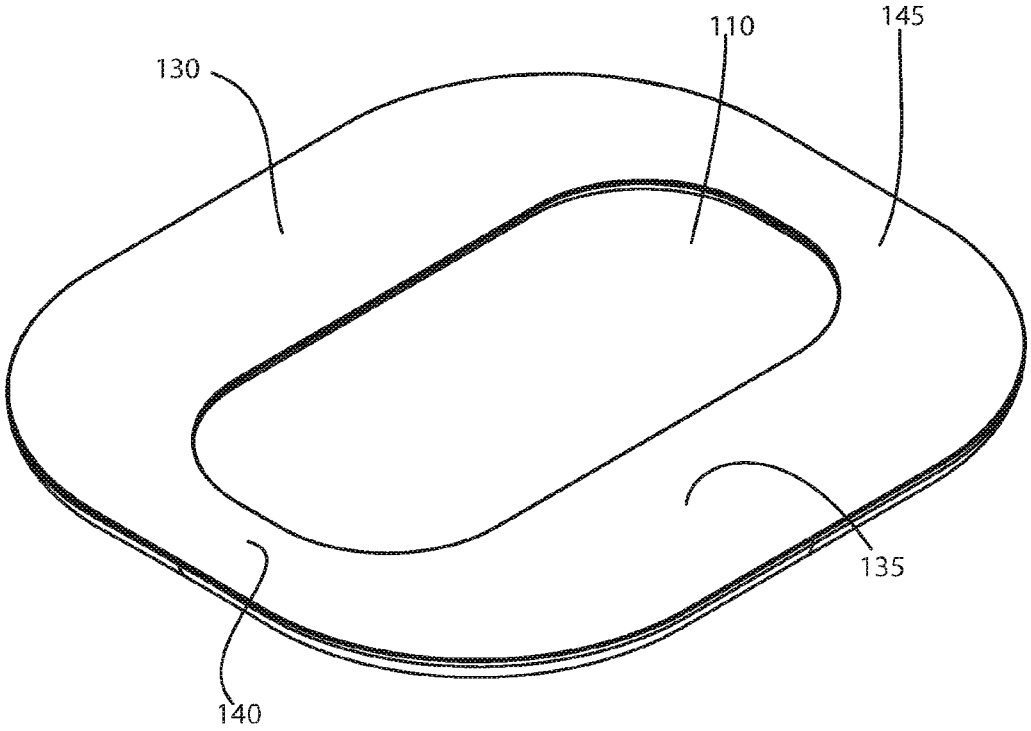
FIG. 18 is a bottom perspective view of an exemplary ring-shaped stance guide without spikes according to principles of the invention.
Figure 19:
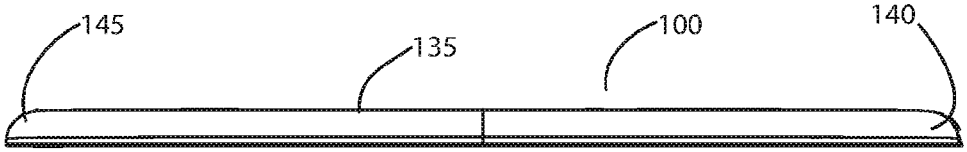
FIG. 19 is a front view of an exemplary ring-shaped stance guide without spikes according to principles of the invention.
Figure 20:
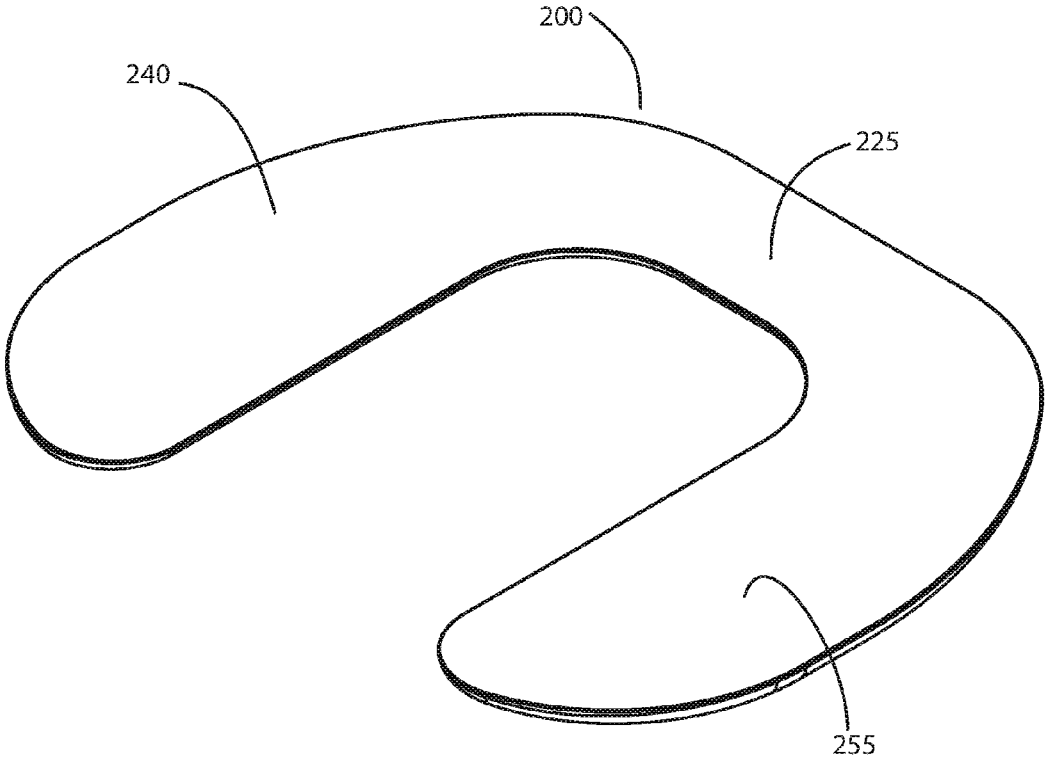
FIG. 20 is a bottom perspective view of an exemplary u-shaped stance guide without spikes according to principles of the invention.
Figure 21:
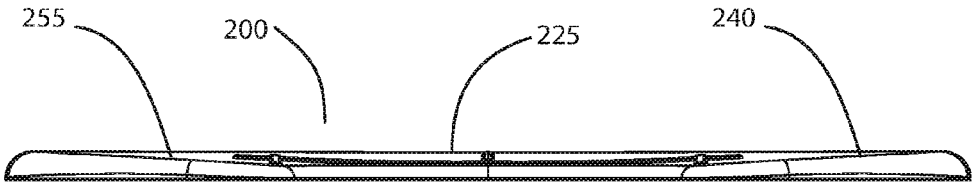
FIG. 21 is a front view of an exemplary u-shaped stance guide without spikes according to principles of the invention.

Spikes, while desirable for traction in many applications on turf, are not necessary and possible detrimental when the guide is used on certain surfaces such as flooring. FIGS. 18 and 19 provide bottom perspective and front views of an exemplary ring-shaped stance guide without spikes according to principles of the invention. Similarly, FIGS. 20 and 21 provide bottom perspective and front views of an exemplary u-shaped stance guide without spikes according to principles of the invention. In each case, the bottom surface may be comprised of the same material as the body of the guide, or may be overmolded or coated with a non-slip elastomeric material.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A stance guide comprising a front side having a front side length greater than a width of a shoe, a left end and a right end opposite the left end, a left side extending from the left end of the front side, the left side being elongate and substantially perpendicular to the front side, a right side extending from the right end of the front side, the right side being elongate and substantially perpendicular to the front side and substantially aligned with, spaced apart from, and parallel to the left side, the front side, left side, and right side forming a U-shape with a stance space defined between the left side and the right side, the stance space having a width defined by a distance between the left side and the right side, the width being greater than the width of the shoe, the front side, left side and right side being integrally formed and comprised of flexible elastomer, the flexible elastomer including a plasticizer and a thermochromic additive, and the stance guide changing color at a determined temperature, said stance guide conforming to a contour of a terrain on which the stance guide is placed, and each of the front side, left side and right side having an outer edge and an opposite inner edge, the outer edge being sloped to an outer edge height, and the inner edge being sloped to an inner edge height.

2. The stance guide according to claim 1, the front side having a middle between the left end and the right end, and said stance guide further comprising a central guideline at the middle of the front side, the central guideline being visible and substantially parallel to the left side and right side.

3. The stance guide according to claim 2, the central guideline at the middle of the front side being palpable and comprising one of a first linear embossment and a first linear debossment.

4. The stance guide according to claim 2, the inner edge height being less than the outer edge height, and the outer edge height not exceeding one inch.

5. The stance guide according to claim 4, the sloped outer edge comprising one of a filleted, beveled and chamfered outer edge, and the sloped inner edge comprising one of a filleted, beveled and chamfered inner edge.

6. The stance guide according to claim 3, further comprising a front edge guideline on the front side, the front edge guideline being perpendicular to the central guideline, having a front edge guideline length that is less than the front side length, having a first end adjacent to the left end of the front side, having a second end adjacent to the right end of the front side, and extending linearly between the left end and the right end of the front side.

7. The stance guide according to claim 6, the front edge guideline on the front side being palpable and comprising one of a second linear embossment and a second linear debossment.

8. The stance guide according to claim 7, further comprising a left guideline and a right guideline, the left guideline being parallel to and spaced apart from the right guideline, the left guideline and the right guideline being perpendicular to the central guideline, the left guideline extending from the first end of the front edge guideline along a portion of the left side, and the right guideline extending from the second end of the front edge guideline along a portion of the right side.

9. The stance guide according to claim 1, the front side, left side and right side each having a bottom surface, and further comprising plurality of terrain engaging protrusions extending downwardly from each bottom surface.

10. The stance guide according to claim 9, the terrain engaging protrusions comprising conical protrusions.

11. The stance guide according to claim 1, the flexible elastomer including a plasticizer and a phosphorescent additive, and the stance guide phosphorescing.

12. The stance guide according to claim 1, further comprising a back side having a length about equal to the length of the front side, the back side being spaced apart from the front side and parallel to the front side, and the back side having a left end and a right end opposite the left end, the right side extending from the right end of the front side to the right end of the back side, and the left side extending from the left end of the front side to the left end of the back side, the front side, left side, right side and back side forming a oval shape.

13. The stance guide according to claim 12, the front side having a middle between the left end and the right end, and said stance guide further comprising a central guideline at the middle of the front side, the central guideline being visible and substantially parallel to the left side and right side, the central guideline at the middle of the front side being palpable and comprising one of a first linear embossment and a first linear debossment.

14. The stance guide according to claim 13, further comprising a front edge guideline on the front side, the front edge guideline being perpendicular to the central guideline, having a front edge guideline length that is less than the front side length, having a first end adjacent to the left end of the front side, having a second end adjacent to the right end of the front side, and extending linearly between the left end and the right end of the front side, the front edge guideline on the front side being palpable and comprising one of a second linear embossment and a second linear debossment.

15. The stance guide according to claim 14, further comprising a left guideline and a right guideline, the left guideline being parallel to and spaced apart from the right guideline, the left guideline and the right guideline being perpendicular to the central guideline, the left guideline extending from the first end of the front edge guideline along a portion of the left side, and the right guideline extending from the second end of the front edge guideline along a portion of the right side.

16. The stance guide according to claim 15, the inner edge height being less than the outer edge height, and the outer edge height not exceeding one inch, the sloped outer edge comprising one of a filleted, beveled and chamfered outer edge, and the sloped inner edge comprising one of a filleted, beveled and chamfered inner edge.

17. The stance guide according to claim 16, the front side, left side and right side each having a bottom surface, and further comprising plurality of terrain engaging protrusions extending downwardly from each bottom surface, the terrain engaging protrusions comprising conical protrusions.

* * * * *